US012583572B2

(12) United States Patent
Ikegaya

(10) Patent No.: US 12,583,572 B2
(45) Date of Patent: Mar. 24, 2026

(54) MARINE VESSEL AND MARINE VESSEL PROPULSION CONTROL SYSTEM

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 236 days.

(21) Appl. No.: 18/073,647

(22) Filed: Dec. 2, 2022

(65) Prior Publication Data

US 2023/0192264 A1 Jun. 22, 2023

(30) Foreign Application Priority Data

Dec. 21, 2021 (JP) ..... 2021-207063

(51) Int. Cl.

| | |
|---|---|
| ***B63H 25/42*** | (2006.01) |
| ***B63H 20/00*** | (2006.01) |
| ***B63H 20/12*** | (2006.01) |
| ***B63H 25/02*** | (2006.01) |
| ***B63H 25/04*** | (2006.01) |

(52) U.S. Cl.

CPC ..... *B63H 25/42* (2013.01); *B63H 20/12* (2013.01); *B63H 25/04* (2013.01); *B63H 2020/003* (2013.01); *B63H 2025/026* (2013.01)

(58) Field of Classification Search

CPC ..... B63H 25/42

See application file for complete search history.

(56) References Cited

U.S. PATENT DOCUMENTS

| | | | | |
|---|---|---|---|---|
| 6,234,853 | B1 * | 5/2001 | Lanyi | B63H 21/22 114/144 R |
| 6,511,354 | B1 * | 1/2003 | Gonring | B63H 25/02 440/87 |
| 7,267,588 | B1 * | 9/2007 | Griffiths | B63H 20/12 440/63 |

(Continued)

OTHER PUBLICATIONS

Extended European Search Report in EP22210821.9, mailed May 31, 2023, 10 pages.

(Continued)

*Primary Examiner* — Jean Paul Cass

(74) *Attorney, Agent, or Firm* — Keating & Bennett, LLP

(57) ABSTRACT

A marine vessel includes propulsion devices, an operator to move the marine vessel in a tilting direction of the operator, and a controller to control a magnitude and a direction of a thrust generated by each of the propulsion devices to move the marine vessel in the tilting direction of the operator. When the operator is tilted toward a lateral direction, the controller executes a first control to move the marine vessel in the lateral direction, and causes each of the propulsion devices to generate a thrust to eliminate a deviation of the marine vessel in a front-rear direction from a position of the marine vessel when the operator was tilted. When the operator is tilted in the front-rear direction of the marine vessel while the marine vessel moves in the lateral direction, the controller interrupts the first control and executes a second control to cause each of the propulsion devices to generate a thrust corresponding to the tilting of the operator.

13 Claims, 12 Drawing Sheets

(56) References Cited

U.S. PATENT DOCUMENTS

| | | | | |
|---|---|---|---|---|
| 7,467,595 | B1 * | 12/2008 | Lanyi | B63H 25/02 114/144 R |
| 8,925,414 | B1 * | 1/2015 | Park | B63H 21/213 74/543 |
| 9,039,468 | B1 * | 5/2015 | Arbuckle | B63H 25/04 440/79 |
| 9,434,460 | B1 * | 9/2016 | Samples | B63H 20/12 |
| 10,095,232 | B1 * | 10/2018 | Arbuckle | B63H 25/42 |
| 10,913,524 | B1 * | 2/2021 | Wald | B63H 20/12 |
| 11,091,243 | B1 * | 8/2021 | Gable | B63H 25/46 |
| 11,565,783 | B1 * | 1/2023 | Wald | B63H 25/42 |
| 11,904,997 | B1 * | 2/2024 | Wald | B63H 20/12 |
| 12,065,230 | B1 * | 8/2024 | Derginer | B63H 20/12 |
| 2007/0028824 | A1 * | 2/2007 | Stallings | B63H 25/42 114/151 |
| 2008/0269968 | A1 * | 10/2008 | Stewart | B63H 21/213 440/84 |
| 2014/0364018 | A1 | 12/2014 | Hara et al. | |
| 2015/0166159 | A1 | 6/2015 | Inoue et al. | |
| 2017/0349257 | A1 | 12/2017 | Hara et al. | |
| 2019/0112021 | A1 * | 4/2019 | Watanabe | B63H 5/08 |
| 2021/0286362 | A1 * | 9/2021 | Malouf | B63H 5/14 |

OTHER PUBLICATIONS

Yamaha, "Helm Master-EX," Youtube.com, Retrieved from Internet:<https:www.youtube.com/watch?v=qNzBa2yqrPs>, Course hold mode shown between 0:41-0:52, Apr. 19, 2021, 3 pages.

Yamaha Motor Co., Ltd., "Helm Master EX, Next generation boat control system", URL: https://www.yamaha-motor.co.jp/marine/lineup/outboard/helmmasterex/, retrieved on Dec. 14, 2021, 4 pages.

* cited by examiner

MARINE VESSEL AND MARINE VESSEL PROPULSION CONTROL SYSTEM

CROSS REFERENCE TO RELATED APPLICATIONS

This application claims the benefit of priority to Japanese Patent Application No. 2021-207063, filed on Dec. 21, 2021. The entire contents of this application are hereby incorporated herein by reference.

BACKGROUND OF THE INVENTION

1. Field of the Invention

The present invention relates to a marine vessel and a marine vessel propulsion control system.

2. Description of the Related Art

For the purpose of improving operability, marine vessels that are each provided with a joystick, which is a marine vessel maneuvering mechanism separate from a steering and a remote control unit, are known. In such a marine vessel, the marine vessel moves in a direction toward which a marine vessel user tilts the joystick, and a moving speed of the marine vessel at that time changes according to a tilting amount of the joystick (For example, see "Helm Master EX", [online], Yamaha Motor Co., Ltd., [searched on Dec. 14, 2021], Internet <URL: https://www.yamaha-motor.co.jp/marine/lineup/outboard/helmmasterex/>).

For example, when the marine vessel user wants to move the marine vessel in a lateral direction perpendicular to a front-rear direction (a longitudinal direction) of a hull of the marine vessel, the marine vessel user tilts the joystick toward the lateral direction, and the marine vessel moves in the lateral direction according to the tilting of the joystick. However, external disturbances such as tidal currents and wind acting on the hull, and sometimes a momentum of the speed of the marine vessel itself, may cause the marine vessel to move in the front-rear direction during movement in the lateral direction, such that sometimes the marine vessel moves forward or backward while deviating from a tilting direction of the joystick. Therefore, a control is performed to reduce the moving speed of the marine vessel in the front-rear direction at a point in time when the marine vessel starts to move in the lateral direction.

However, since it takes some time for the moving speed of the marine vessel in the front-rear direction to sufficiently decrease, the marine vessel will move somewhat in the front-rear direction while moving in the lateral direction. Furthermore, since the marine vessel receives the external disturbances during movement in the lateral direction and rotates (turns) in a yaw direction, the marine vessel 100 rotates according to the turning of the marine vessel as shown in FIG. 12, and sometimes moves in a direction (a direction indicated by a dashed arrow in FIG. 12) which is different from a lateral direction initially desired by the marine vessel user (a direction indicated by a hollow arrow in FIG. 12). Therefore, there is room for improvement in holding the course of the marine vessel 100 in the lateral direction when the marine vessel user tilts the joystick 101 toward the lateral direction.

SUMMARY OF THE INVENTION

Preferred embodiments of the present invention provide marine vessels and marine vessel propulsion control systems that are each able to cause a marine vessel to hold a course in a lateral direction desired by a marine vessel user.

According to a preferred embodiment of the present invention, a marine vessel includes a plurality of propulsion devices that are each able to individually control a magnitude and a direction of a thrust generated by the respective propulsion device, an operator to move the marine vessel in a tilting direction of the operator, and a controller configured or programmed to control the magnitude and the direction of the thrust generated by each of the plurality of propulsion devices so as to move the marine vessel in the tilting direction of the operator. When the operator is tilted toward a lateral direction perpendicular to a front-rear direction of the marine vessel, the controller is configured or programmed to execute a first control to move the marine vessel in the lateral direction, and to cause each of the plurality of propulsion devices to generate a thrust to eliminate a deviation of the marine vessel in the front-rear direction from a position of the marine vessel when the operator was tilted. When the operator is tilted in the front-rear direction while the marine vessel moves in the lateral direction, the controller is configured or programmed to interrupt the first control and execute a second control to cause each of the plurality of propulsion devices to generate a thrust corresponding to the tilting of the operator in the front-rear direction.

According to another preferred embodiment of the present invention, a marine vessel propulsion control system able to individually control magnitudes and directions of thrusts generated by a plurality of propulsion devices includes an operator to move the marine vessel in a tilting direction of the operator, and a controller configured or programmed to control the magnitude and the direction of the thrust generated by each of the plurality of propulsion devices to move the marine vessel in the tilting direction of the operator. When the operator is tilted toward a lateral direction perpendicular to a front-rear direction of the marine vessel, the controller is configured or programmed to execute a first control to move the marine vessel in the lateral direction, and to cause each of the plurality of propulsion devices to generate a thrust to eliminate a deviation of the marine vessel in the front-rear direction from a position of the marine vessel when the operator was tilted. When the operator is tilted in the front-rear direction while the marine vessel moves in the lateral direction, the controller is configured or programmed to interrupt the first control and execute a second control to cause each of the plurality of propulsion devices to generate a thrust corresponding to the tilting of the operator in the front-rear direction.

According to another preferred embodiment of the present invention, a marine vessel includes a plurality of propulsion devices that are each able to individually control a magnitude and a direction of a thrust generated by the respective propulsion device, an operator to move the marine vessel in a tilting direction of the operator, and a controller configured or programmed to control the magnitude and the direction of the thrust generated by each of the plurality of propulsion devices to move the marine vessel in the tilting direction of the operator. When the operator is tilted toward a lateral direction perpendicular to a front-rear direction of the marine vessel, the controller is configured or programmed to set a movement target line extending in the lateral direction, and to move the marine vessel along the movement target line.

According to a preferred embodiment of the present invention, the controller is configured or programmed to cause the marine vessel to move in the lateral direction, and to cause each of the plurality of propulsion devices to generate a thrust to eliminate the deviation of the marine vessel in the front-rear direction from the position of the marine vessel when the operator was tilted. Alternatively, the controller is configured or programmed to set the movement target line extending in the lateral direction according to the tilting of the operator toward the lateral direction, and to move the marine vessel along the movement target line. As a result, when the marine vessel moves in the lateral direction, it is possible to stop the marine vessel from deviating in the front-rear direction from the position of the marine vessel when the operator was tilted. Therefore, it is possible to cause the marine vessel to hold the course in the lateral direction desired by the marine vessel user.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
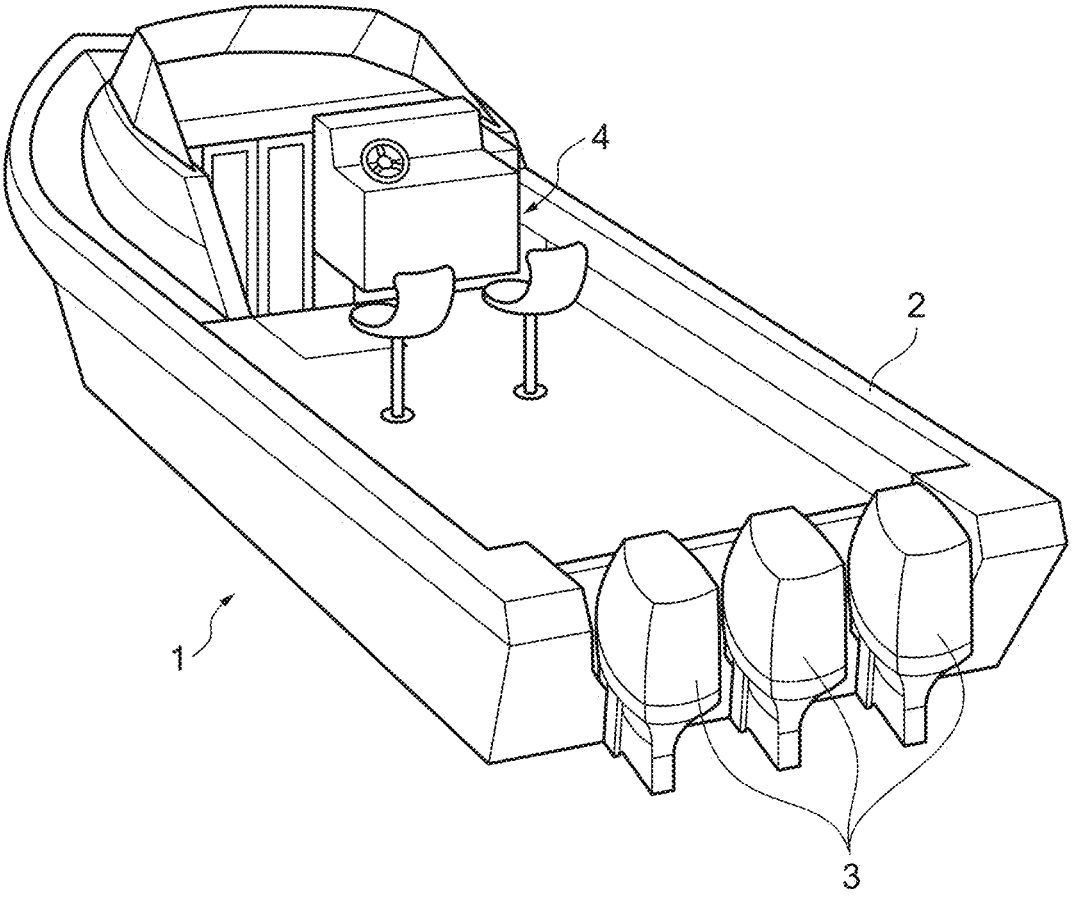
FIG. 1 is a perspective view of a marine vessel provided with a marine vessel propulsion control system according to a preferred embodiment of the present invention.

FIG. 1 is a perspective view of a marine vessel provided with a marine vessel propulsion control system 15 according to a preferred embodiment of the present invention. A marine vessel 1 includes a hull 2, and a plurality of, for example, three outboard motors 3 that function as propulsion devices and are mounted on the hull 2. It should be noted that the number of the outboard motors 3 provided on the marine vessel 1 is not limited to three, and may be two or four or more. The three outboard motors 3 are mounted side by side on the stern of the hull 2. Each outboard motor 3 includes an engine (not shown) which is, for example, an internal combustion engine functioning as a power source, and obtains a thrust from a propeller (not shown) which is rotated by a driving force of the corresponding engine. It should be noted that each outboard motor 3 may include an electric motor functioning as the power source, or may include both an engine and an electric motor functioning as the power source.

Figure 2:
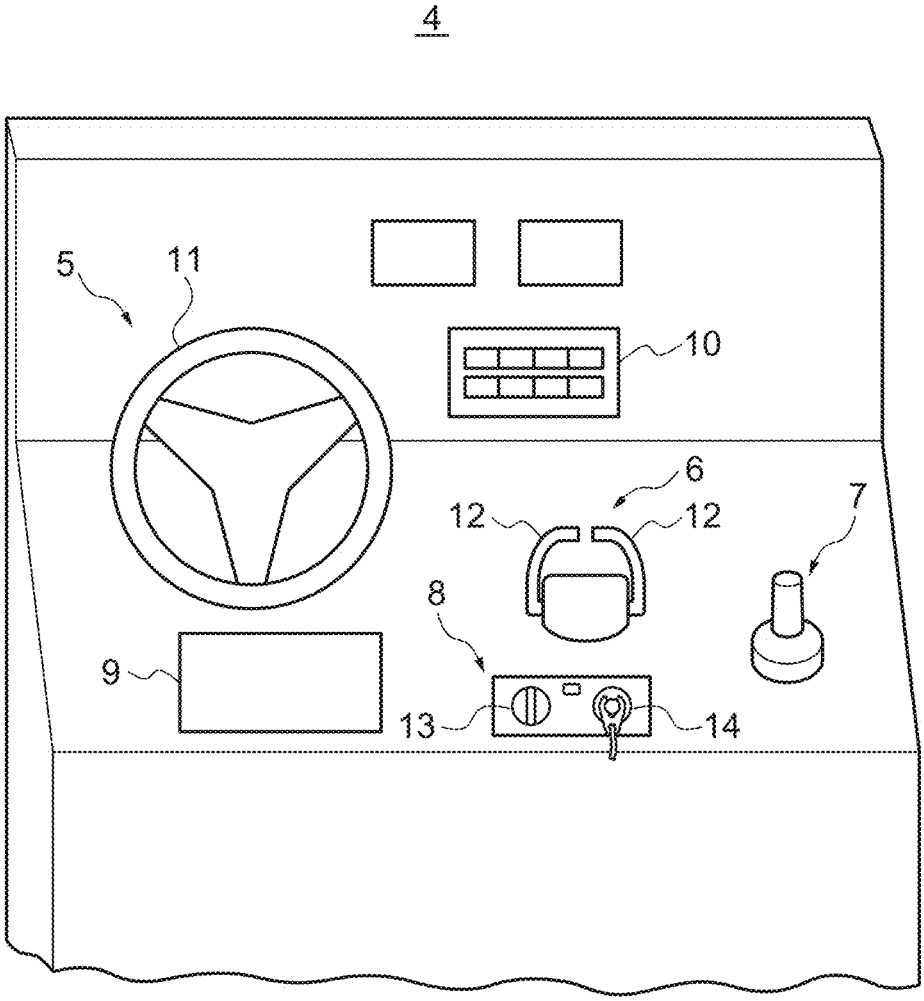
FIG. 2 is a perspective view of a principal portion of a maneuvering seat of the marine vessel of FIG. 1.

In addition, in the marine vessel 1, a maneuvering seat 4 is provided on the bow side, which is the front portion of the hull 2. FIG. 2 is a perspective view of a principal portion of the maneuvering seat 4. A steering mechanism 5, a remote control unit 6, a joystick 7, a main operation unit 8, a multi function display (an MFD) 9, and a maneuvering panel 10 are located on the maneuvering seat 4.

The steering mechanism 5 enables a marine vessel user to determine a course of the marine vessel 1. The steering mechanism 5 includes a steering wheel 11 which is rotatable. The marine vessel user is able to turn the marine vessel 1 to the left or the right by rotating the steering wheel 11 to the left or the right. The remote control unit 6 includes levers 12 corresponding to the outboard motors 3, respectively. By operating each lever 12, the marine vessel user is able to switch a direction of the thrust generated by the corresponding outboard motor 3 between a forward moving direction and a backward moving direction, and adjust the output of the corresponding outboard motor 3 so as to adjust a vessel speed of the marine vessel 1.

The joystick 7 is a control stick for the marine vessel user to navigate the marine vessel 1. In a normal mode, the outboard motor 3 works mainly according to an operation of the steering mechanism 5 and an operation of the remote control unit 6. On the other hand, in a joystick mode, the outboard motor 3 works mainly according to an operation of the joystick 7. It is possible to switch between the normal mode and the joystick mode by a change-over switch (not shown).

The main operation unit 8 includes a main switch 13 and an engine shutoff switch 14. The main switch 13 (one main switch 13) is provided in common for the outboard motors 3 (respective outboard motors 3). The main switch 13 is an operator to collectively start and collectively stop the engines of the outboard motors 3 (the respective outboard motors 3). The engine shutoff switch 14 is a switch for emergency-stopping the engines of the outboard motors 3 (the respective outboard motors 3).

The MFD 9 includes, for example, a color LCD display. The MFD 9 functions as a display to display various kinds of information, and also functions as a touch panel to accept inputs from the marine vessel user.

Figure 3:
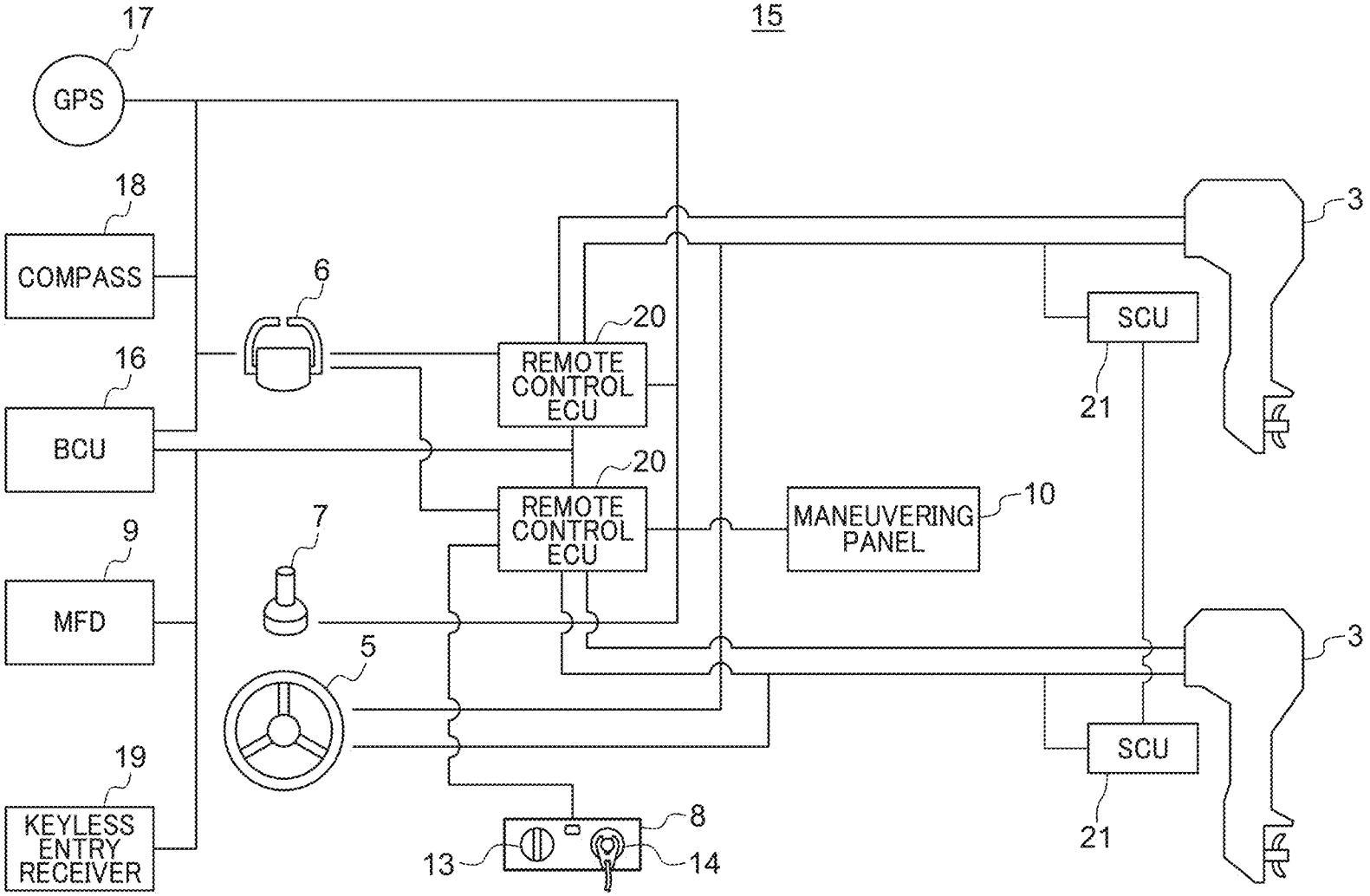
FIG. 3 is a block diagram for schematically explaining a configuration of the marine vessel propulsion control system mounted on the marine vessel of FIG. 1.

FIG. 3 is a block diagram for schematically explaining a configuration of the marine vessel propulsion control system 15 mounted on the marine vessel 1 of FIG. 1. As shown in FIG. 3, the marine vessel propulsion control system 15 includes the outboard motors 3, a boat control unit (a BCU) 16 functioning as a controller, the MFD 9, a global positioning system (a GPS) 17, a compass 18, a keyless entry receiver 19, the remote control unit 6, the joystick 7, the steering mechanism 5, the maneuvering panel 10, remote control engine control units (remote control ECUs) 20, the main operation unit 8, and steering control units (SCUs) 21. Respective components of the marine vessel propulsion control system 15 are communicably connected to each other. It should be noted that although the marine vessel 1 is originally equipped with the three outboard motors 3, in order to avoid complicated wiring in FIG. 3, two outboard motors 3 are drawn in FIG. 3 for convenience.

The GPS 17 obtains the current position of the marine vessel 1 and transmits the current position of the marine vessel 1 to the BCU 16. The compass 18 obtains a direction (a yaw angle) of the marine vessel 1 and transmits the direction of the marine vessel 1 to the BCU 16.

Figure 4:
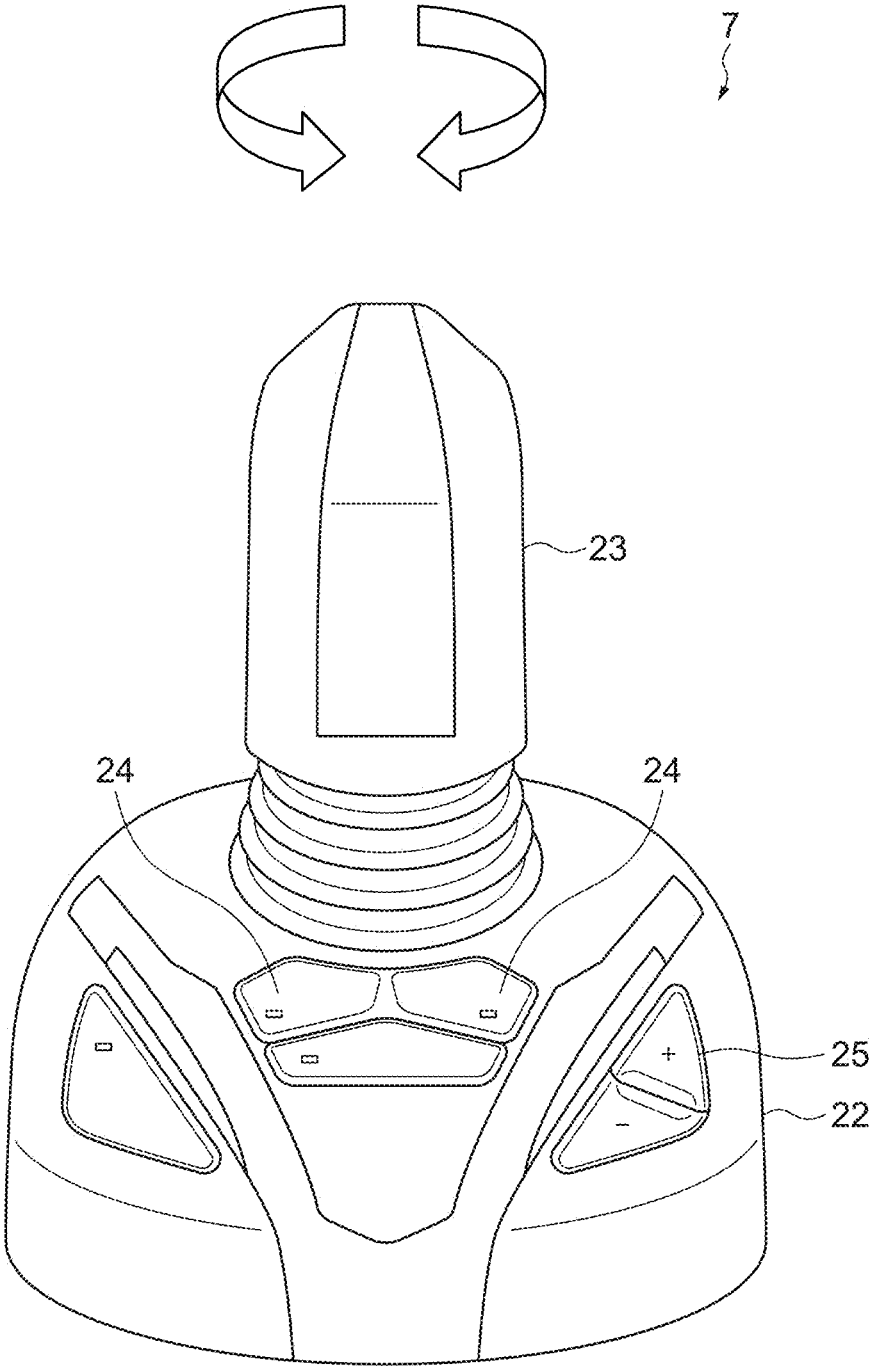
FIG. 4 is an external view that schematically shows a configuration of a joystick shown in FIG. 3.

FIG. 4 is an external view that schematically shows a configuration of the joystick 7 shown in FIG. 3. As shown in FIG. 4, the joystick 7 includes a base 22, a rod-shaped stick 23 (an operator) attached to the top of the base 22, and a plurality of buttons 24 provided on the base 22.

The stick 23 is able to swing freely with respect to the base 22 so that the marine vessel user is able to intuitively perform maneuvering of the marine vessel 1. In the joystick mode, for example, when the marine vessel user tilts the stick 23 forward or backward, the joystick 7 emits a signal to move the marine vessel 1 forward or backward, and when the marine vessel user tilts the stick 23 toward the left or the right, the joystick 7 emits a signal to move the marine vessel 1 to the left or the right. In addition, the stick 23 is able to be twisted (moved rotationally) with respect to the base 22 (see arrows in FIG. 4). When the marine vessel user twists the stick 23, the joystick 7 emits a signal to turn the marine vessel 1. Furthermore, the joystick 7 emits a signal to generate a thrust corresponding to a tilting amount of the stick 23. The signals from the joystick 7 are transmitted to each of the remote control ECUs 20 and the BCU 16.

In the joystick mode, by operating the stick 23, the marine vessel user is able to navigate the marine vessel 1 with a course corresponding to a tilting direction of the stick 23 and the thrust corresponding to the tilting amount of the stick 23.

Instructions to start/end various kinds of maneuvering modes are assigned to the plurality of buttons 24 of the joystick 7, and depending which of the plurality of buttons 24 is pressed, the joystick 7 transmits an instruction signal to start or end a maneuvering mode corresponding to which of the plurality of buttons 24 is pressed to each of the remote control ECUs 20 and the BCU 16. The maneuvering modes that are able to be selected by each of the plurality of buttons 24 include, for example, a fixed point holding mode.

In addition, by using the joystick 7, the marine vessel user is able to set the level of the thrust generated by the engine of each outboard motor 3 when the marine vessel user tilts the stick 23 in the joystick mode (hereinafter, referred to as "a thrust level"). Specifically, when the marine vessel user presses down the "+" side of a button 25 provided on the base 22, the thrust level increases, and when the marine vessel user presses down the "−" side of the button 25, the thrust level decreases. The joystick 7 transmits the content of an operation input to the button 25 to the BCU 16, and the BCU 16 changes the thrust level according to the content of the operation input to the button 25.

It should be noted that the maneuvering panel 10 also includes buttons similar to the plurality of buttons 24 and the button 25. By using the maneuvering panel 10, the marine vessel user is able to select various kinds of maneuvering modes and is also able to set the thrust level.

Returning to FIG. 3, the steering mechanism 5 accepts the operation with respect to the steering wheel 11 performed by the marine vessel user, and transmits a steering angle corresponding to the accepted operation to each of the remote control ECUs 20. The keyless entry receiver 19 is a radio wave receiver that receives an operation input signal of an external key (not shown) as a radio wave. For example, the keyless entry receiver 19 receives operation input signals of the external key to the main switch and a start/stop switch, and transmits these signals to the BCU 16 and each of the remote control ECUs 20.

The SCU 21 is provided corresponding to each outboard motor 3, and controls a steering unit (not shown) that horizontally turns the corresponding outboard motor 3 with respect to the hull 2 of the marine vessel 1 so as to change an acting direction of the thrust of each outboard motor 3.

The BCU 16 obtains the state of the marine vessel 1 based on the signals transmitted from the respective components of the marine vessel propulsion control system 15, determines the magnitude of a thrust that each outboard motor 3 should generate and an acting direction of the thrust that should be taken, and transmits the result of these determinations to each of the remote control ECUs 20. The remote control ECU 20 is provided for each outboard motor 3, and controls the engine of the corresponding outboard motor 3 and the steering unit in response to the signals transmitted from the BCU 16, the steering mechanism 5, the remote control unit 6, the joystick 7, etc. so as to adjust the thrust and the acting direction of the thrust of the corresponding outboard motor 3. Therefore, in the marine vessel propulsion control system 15, by the marine vessel user operating the steering wheel 11 of the steering mechanism 5, the joystick 7 or the levers of the remote control unit 6, it is possible to control the vessel speed and the yaw angle of the marine vessel 1.

When the marine vessel 1 avoids other marine vessels within a harbor or when the marine vessel 1 docks with a quay, the marine vessel 1 often moves in a lateral direction perpendicular to a front-rear direction (a keel direction) of the hull 2.

When the marine vessel 1 moves in the lateral direction, it is necessary to individually adjust the acting direction and the magnitude of the thrust of each outboard motor 3 so that a resultant force of the thrusts of the respective outboard motors 3 (hereinafter, referred to as "a resultant thrust") becomes a lateral direction thrust with respect to the marine vessel 1. However, this adjustment is quite difficult for the marine vessel user because it is necessary to make the acting direction of the thrust of one outboard motor 3 different from that of the other outboard motors 3. Therefore, in general, when the BCU 16 detects tilting of the stick 23 of the joystick 7 toward the lateral direction by the marine vessel user, the BCU 16 individually adjusts the acting direction and the magnitude of the thrust of each outboard motor 3 so as to generate the thrust to move the marine vessel 1 in the lateral direction. Such adjustment of the acting direction and the magnitude of the thrust of each outboard motor 3 to move the marine vessel 1 in the lateral direction, which is performed by the BCU 16, is generally referred to as "lateral assist".

On the other hand, during movement of the marine vessel 1 in the lateral direction, since the external disturbances such as tidal currents and wind act on the hull 2, sometimes the yaw angle of the marine vessel 1 changes and the lateral direction perpendicular to the front-rear direction of the hull 2 rotates, and as a result, the lateral direction perpendicular to the front-rear direction of the hull 2 becomes deviated from a lateral direction when the marine vessel user first starts to tilt the stick 23 toward the lateral direction. In addition, of the lateral assist, the BCU 16 continues to generate the resultant thrust to move the marine vessel 1 in the lateral direction perpendicular to the front-rear direction of the hull 2, which sometimes results in the marine vessel 1 moving in a direction which is different from a lateral direction initially desired by the marine vessel user.

According to a preferred embodiment of the present invention, in order to compensate for this issue, a line along the lateral direction when the marine vessel user starts to tilt the stick 23 toward the lateral direction is set as a movement target line, and of the lateral assist, the BCU 16 controls the acting direction and the magnitude of the thrust of each outboard motor 3 so that the marine vessel 1 does not move away from the movement target line when the marine vessel 1 moves in the lateral direction.

Figure 5:
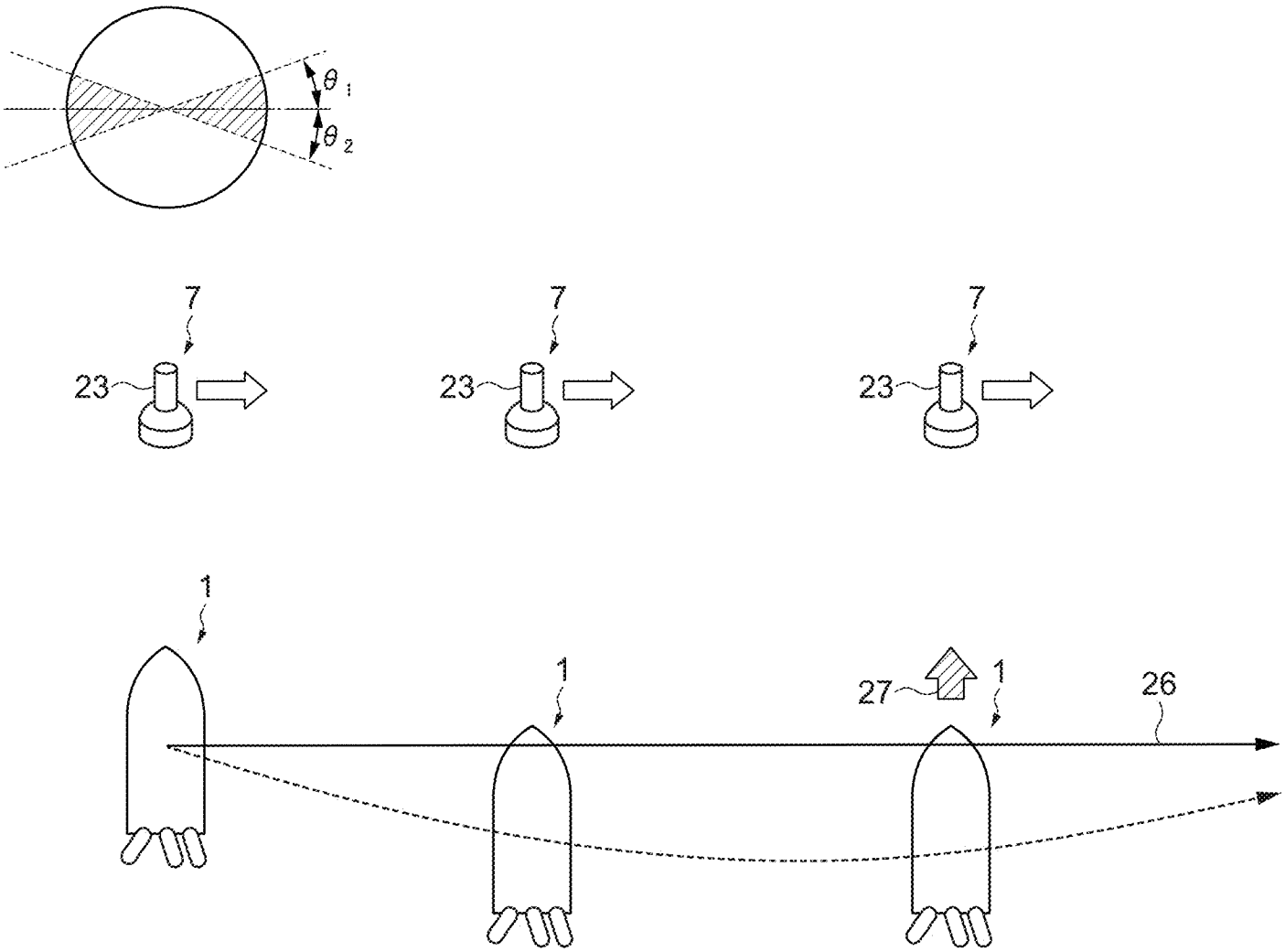
FIG. 5 is a view for explaining lateral assist according to a preferred embodiment of the present invention.

FIG. 5 is a view for explaining the lateral assist according to a preferred embodiment of the present invention. It should be noted that in FIGS. 5, 6, 8, 9, and 10, a hollow arrow near the stick 23 indicates the tilting direction of the stick 23, and a dashed arrow indicates an actual moving track of the marine vessel 1. It should also be noted that in FIGS. 5, 6, 8, 9, and 10, the state of tilting or rotation of the joystick 7 in each state of the marine vessel 1 is shown above the marine vessel 1 in each state.

As shown in FIG. 5, first, when the marine vessel user tilts the stick 23 of the joystick 7 toward the lateral direction, the BCU 16 sets a line along a lateral direction perpendicular to the front-rear direction of the hull 2 at that time as a movement target line 26. A direction of the movement target line 26 is based on the earth coordinate system and is not affected by the turning of the marine vessel 1.

After that, while the marine vessel user continues to tilt the stick 23 toward the lateral direction, although the BCU 16 continues to generate the resultant thrust to move the marine vessel 1 in the lateral direction, at this time, the orientation of each outboard motor 3 is changed so that the three outboard motors 3 form an inverted V shape in a plan view. Also, when it is desired to move the marine vessel 1 to the right in FIG. 5, the outboard motor 3 of the starboard and the outboard motor 3 of the center are caused to generate a backward moving direction thrust, and the outboard motor 3 of the port side is caused to generate a forward moving direction thrust.

Then, when the marine vessel 1 deviates in the front-rear direction from the movement target line 26 while moving in the lateral direction, the BCU 16 performs a correction control in the front-rear direction (first control) that changes the resultant thrust so as to eliminate a deviation in the front-rear direction of the marine vessel 1 from the movement target line 26.

Figure 6:
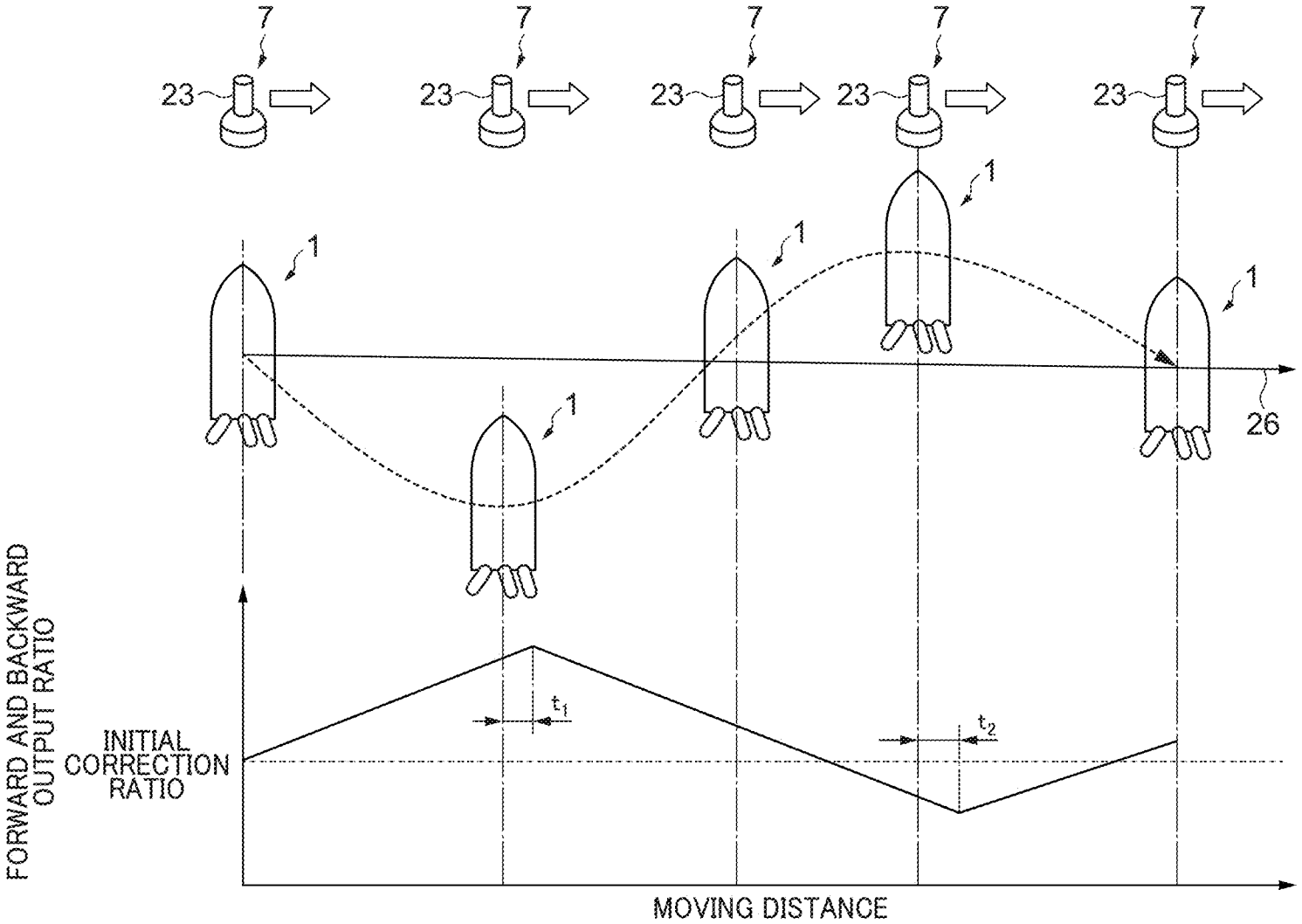
FIG. 6 is a graph for explaining a change in a resultant thrust during correction control in a front-rear direction of the lateral assist according to a preferred embodiment of the present invention.

FIG. 6 is a graph for explaining a change in the resultant thrust during the correction control in the front-rear direction of the lateral assist according to a preferred embodiment of the present invention. In FIG. 6, the horizontal axis indicates a moving distance of the marine vessel 1, and the vertical axis indicates a forward and backward output ratio which is a ratio of output(s) of the outboard motor(s) 3 generating the forward moving direction thrust among the plurality of the outboard motors 3 (hereinafter, referred to as "a forward moving output") to output(s) of the outboard motor(s) 3 generating the backward moving direction thrust among the plurality of the outboard motors 3 (hereinafter, referred to as "a backward moving output"). The forward and backward output ratio is calculated by the following Expression 1.

$$\text{The forward and backward output ratio} = \text{the forward moving output}/\text{the backward moving output} \quad \text{Expression 1}$$

Furthermore, an initial correction ratio in FIG. 6 is a forward and backward output ratio in the case that the resultant thrust does not have a component in the front-rear direction and consists only of the thrust in the lateral direction.

As shown in FIG. 6, while the marine vessel 1 is moving in the lateral direction, when the marine vessel 1 deviates backward from the movement target line 26 due to the external disturbances or the like, the BCU 16 makes the forward and backward output ratio higher than the initial correction ratio to move the marine vessel 1 forward and eliminate the deviation of the marine vessel 1 from the movement target line 26. Further, when the marine vessel 1 deviates forward from the movement target line 26 due to the external disturbances or the like, the BCU 16 makes the forward and backward output ratio lower than the initial correction ratio to move the marine vessel 1 backward and eliminate the deviation of the marine vessel 1 from the movement target line 26. For example, as shown in FIG. 5, while the marine vessel 1 is moving in the lateral direction, when the marine vessel 1 deviates backward from the movement target line 26, the BCU 16 increases the forward and backward output ratio to generate a front-rear direction component 27 (see the hatched arrow in FIG. 5) in the resultant thrust to stop the marine vessel 1 from moving away from the movement target line 26.

It should be noted that in order to avoid that the marine vessel 1 suddenly moves forward or backward, the forward and backward output ratio is not changed sharply, but is changed gradually as shown in FIG. 6. Specifically, when the marine vessel 1 begins to deviate backward from the movement target line 26, the BCU 16 gradually increases the forward and backward output ratio, and then when the marine vessel 1 begins to move forward toward the movement target line 26, the BCU 16 gradually lowers the forward and backward output ratio. In addition, when the marine vessel 1 begins to deviate forward from the movement target line 26, the BCU 16 gradually lowers the forward and backward output ratio, and then when the marine vessel 1 begins to move backward toward the movement target line 26, the BCU 16 gradually increases the forward and backward output ratio.

It should be noted that in order to reliably return the marine vessel 1 toward the movement target line 26, even in the case that the marine vessel 1 stops deviating from the movement target line 26 and begins to move toward the movement target line 26, the change in the forward and backward output ratio is not immediately changed. Specifically, the BCU 16 starts to lower the forward and backward output ratio after a predetermined time (see t1 in FIG. 6) has elapsed since the marine vessel 1 deviated backward from the movement target line 26 and starts to move forward toward the movement target line 26. In addition, the BCU 16 starts to increase the forward and backward output ratio after a predetermined time (see t2 in FIG. 6) has elapsed since the marine vessel 1 deviated forward from the movement target line 26 and starts to move backward toward the movement target line 26.

According to a preferred embodiment of the present invention, the BCU 16 calculates the deviation of the marine vessel 1 from the movement target line 26 based on a comparison between the current position of the marine vessel 1 in the earth coordinate system obtained by the GPS 17 and the movement target line 26 in the earth coordinate system.

Also, in order for the BCU 16 to execute the lateral assist of FIG. 5, although it is necessary for the marine vessel user to tilt the stick 23 toward the lateral direction, since it is difficult for the marine vessel user to accurately tilt the stick 23 toward the lateral direction when the marine vessel 1 is moving due the influence of waves and wind, a certain degree of an allowable range of tilting toward the lateral direction is provided. Specifically, as shown in the upper left of FIG. 5, when the stick 23 is tilted within a range (see hatching in FIG. 5) between directions spaced apart rotationally by predetermined angles indicated by a one-dot chain line (θ1 and θ2 in FIG. 5) clockwise and counter-clockwise respectively from the lateral direction, the BCU 16 executes the lateral assist of FIG. 5.

Furthermore, when the tilting amount toward the lateral direction of the stick 23 is less than a predetermined tilting amount, the correction control in the front-rear direction in the lateral assist is terminated, and when the tilting of the stick 23 toward the lateral direction performed by the marine vessel user is released and the stick 23 returns to a neutral position with respect to the lateral direction, the lateral assist itself is terminated.

Figure 7:
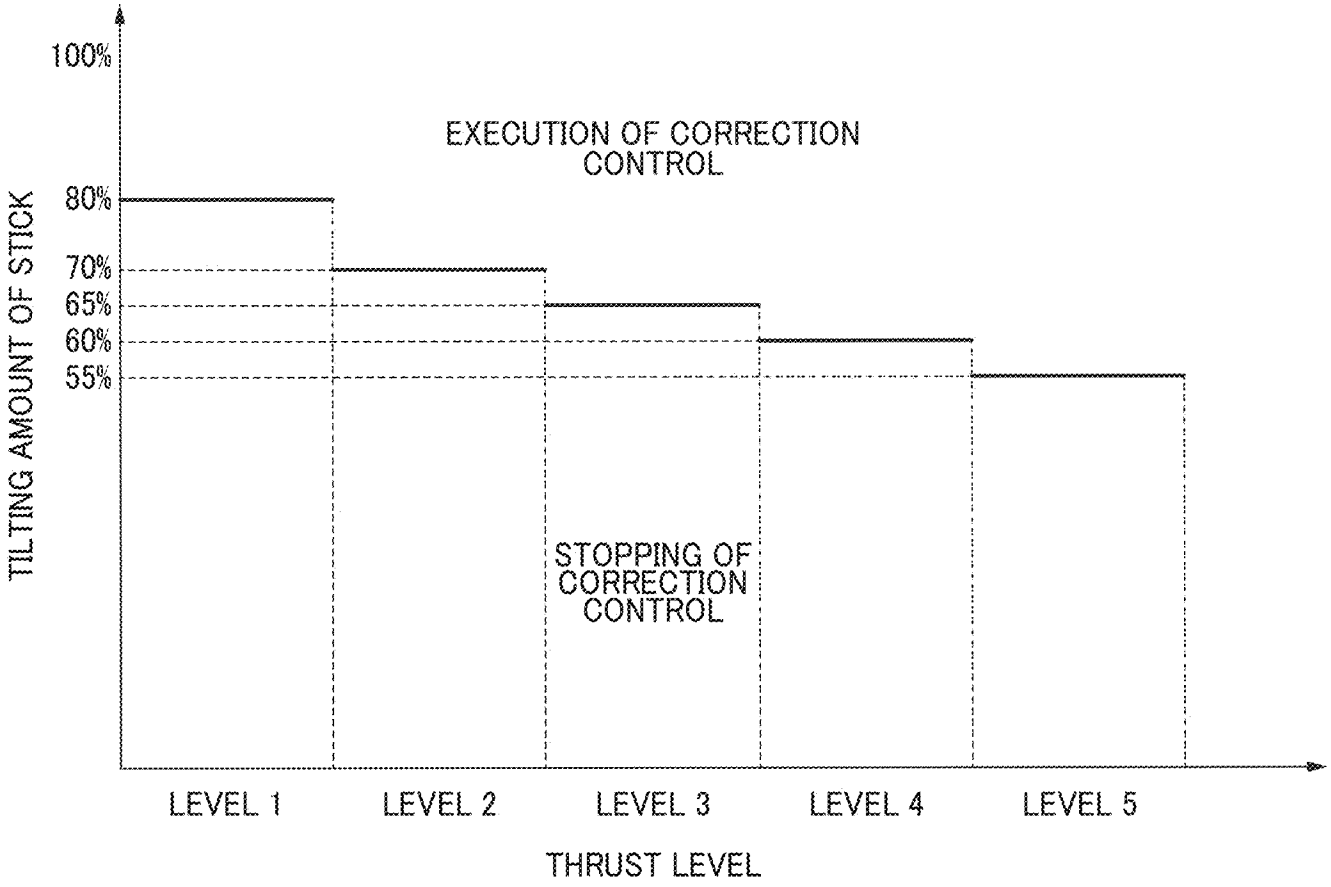
FIG. 7 is a graph for explaining a predetermined tilting amount of a stick used to judge whether or not to terminate the correction control in the front-rear direction of the lateral assist according to a preferred embodiment of the present invention.

FIG. 7 is a graph for explaining the predetermined tilting amount of the stick (hereinafter, referred to as "a tilting amount for judgment") used to judge whether or not to terminate the correction control in the front-rear direction in the lateral assist according to a preferred embodiment of the present invention. According to the present preferred embodiment, in the case that the tilting amount toward the lateral direction of the stick 23 is equal to or more than the tilting amount for judgment, the correction control in the front-rear direction is executed in the lateral assist. On the other hand, in the case that the tilting amount toward the lateral direction of the stick 23 is less than the tilting amount for judgment, the correction control in the front-rear direction is terminated in the lateral assist.

Since the higher the thrust level in the joystick mode, the larger the thrust generated by the engine of each outboard motor 3, when the thrust level is high, the marine vessel user is able to easily feel movement in the lateral direction of the marine vessel 1 even if the stick 23 is not tilted very much. Furthermore, in the case that the marine vessel user feels movement in the lateral direction of the marine vessel 1, when the marine vessel user recognizes that the marine vessel 1 is moving in the lateral direction aimed by the marine vessel user, that is, when the marine vessel user recognizes that the marine vessel 1 will not move away from the movement target line 26, the marine vessel user will feel a sense of security. That is, it is preferable that the correction control in the front-rear direction in the lateral assist is performed in the case that the marine vessel user feels movement in the lateral direction of the marine vessel 1.

Accordingly, according to a preferred embodiment of the present invention, the tilting amount for judgment is changed according to the thrust level. Specifically, the tilting amount for judgment is set lower as the thrust level is higher and the marine vessel user is able to more easily feel movement in the lateral direction of the marine vessel 1 even if the stick 23 is not tilted very much. For example, as shown in FIG. 7, in the case that the thrust level is level 1 where the thrust generated by the engine of each outboard motor 3 is the smallest, the tilting amount for judgment is set to 80% of the total tilting amount of the stick 23, and in the case that the thrust level is level 5 where the thrust generated by the engine of each outboard motor 3 is the largest, the tilting amount for judgment is set to 55% of the total tilting amount of the stick 23.

As a result, in the case that the thrust level is low and the marine vessel user is not able to feel movement in the lateral direction of the marine vessel 1 unless the stick 23 is largely tilted, if the stick 23 is not largely tilted, the correction control in the front-rear direction will not be executed in the lateral assist. On the other hand, in the case that the thrust level is high and the marine vessel user is able to feel movement in the lateral direction of the marine vessel 1 even if the stick 23 is not largely tilted, the correction control in the front-rear direction will be executed in the lateral assist even if the stick 23 is not largely tilted. Conversely, in the case that the thrust level is low and the marine vessel user is not able to feel movement in the lateral direction of the marine vessel 1 when the stick 23 is slightly returned from the tilted state, the correction control in the front-rear direction will be terminated in the lateral assist just by returning the stick 23 slightly from the tilted state. On the other hand, in the case that the thrust level is high and the marine vessel user is not able to feel movement in the lateral direction of the marine vessel 1 unless the stick 23 is largely returned from the tilted state, if the stick 23 is not largely returned from the tilted state, the correction control in the front-rear direction will not be terminated in the lateral assist.

Further, when the lateral assist of FIG. 5 is executed and the marine vessel 1 moves in the lateral direction, there are times when it is desired to actively move the marine vessel 1 in the front-rear direction. In particular, when a beginner navigates the marine vessel 1, since sometimes the movement target line 26 set when the stick 23 is first tilted toward the lateral direction deviates from the target position, there is a demand to actively move the marine vessel 1 in the front-rear direction when the marine vessel 1 moves in the lateral direction. In a preferred embodiment of the present invention, in response to this demand, the operation of tilting the stick 23 toward the front-rear direction performed by the marine vessel user is accepted during execution of the lateral assist.

Figure 8:
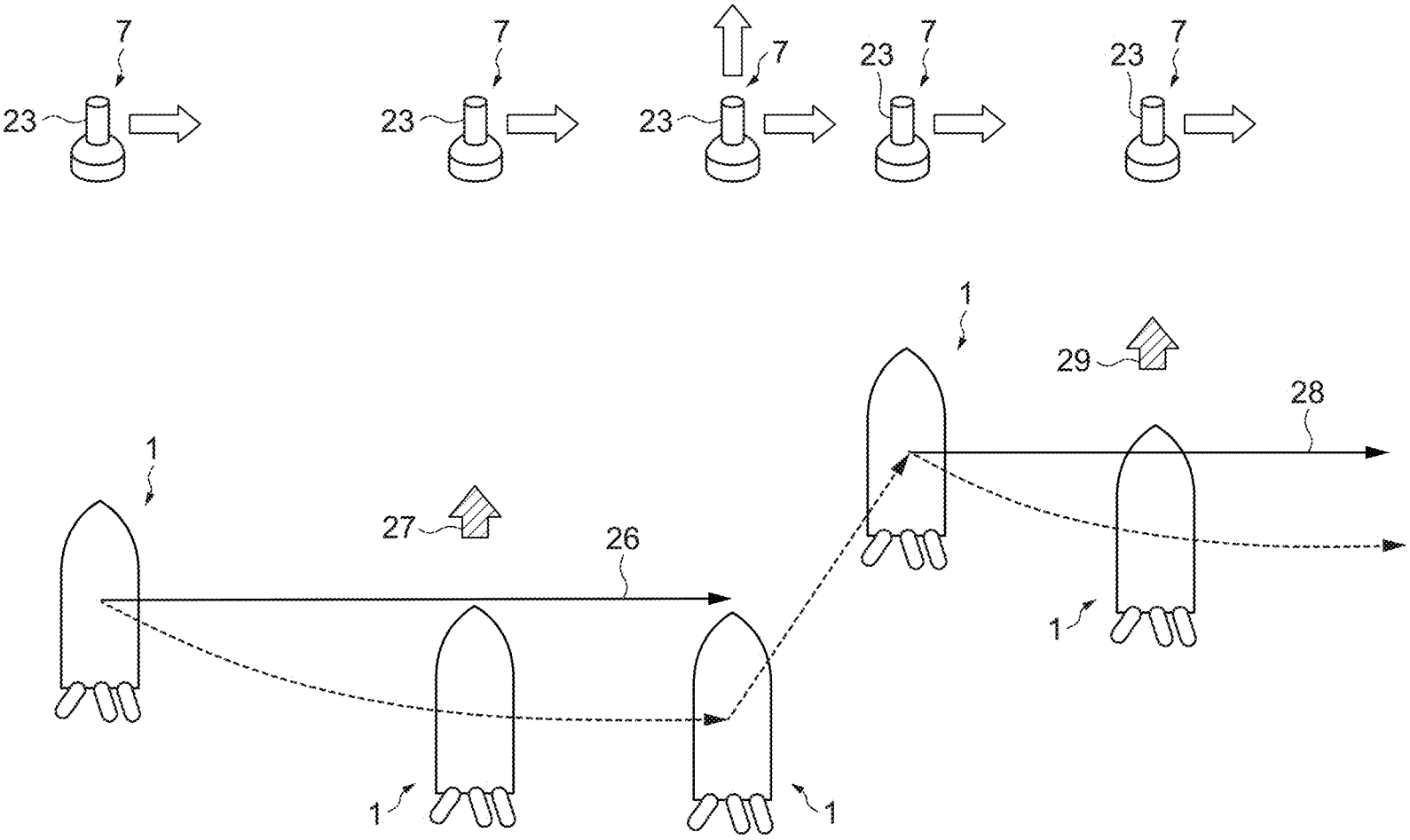
FIG. 8 is a view for explaining movement in the front-rear direction of the lateral assist according to a preferred embodiment of the present invention.

FIG. 8 is a view for explaining movement in the front-rear direction in the lateral assist according to a preferred embodiment of the present invention. When the lateral assist is being executed in response to tilting the stick 23 toward the lateral direction performed by the marine vessel user, the BCU 16 generates the front-rear direction component 27 in the resultant thrust so that the correction control in the front-rear direction described above is executed to eliminate the deviation in the front-rear direction of the marine vessel 1 from the movement target line 26.

After that, when the marine vessel user further tilts the stick 23 toward the front-rear direction of the marine vessel 1 while tilting the stick 23 toward the lateral direction, for example, when the marine vessel user further tilts the stick 23 forward (see the hollow arrow pointing up in FIG. 8) while tilting the stick 23 toward the lateral direction, the BCU 16 temporarily interrupts the correction control in the front-rear direction, and performs midway movement control (second control) that generates a forward component having a magnitude corresponding to an amount of tilting forward of the stick 23 in the resultant thrust. At this time as well, movement in the lateral direction of the marine vessel 1 is continued. As a result, the marine vessel 1 moves obliquely forward (in the right obliquely upward direction in FIG. 8). In addition, the BCU 16 stores the forward and backward output ratio when the correction control in the front-rear direction is interrupted.

Next, when the marine vessel user releases the tilting forward of the stick 23 and returns the stick 23 to the neutral position in the front-rear direction, the BCU 16 ends the midway movement control and terminates generating the forward component of the resultant thrust. Then, the BCU 16 sets a line along a lateral direction perpendicular to the front-rear direction of the hull 2 when the stick 23 is returned to the neutral position in the front-rear direction as a new movement target line 28, and resumes the correction control in the front-rear direction so that the marine vessel 1 does not deviate from the new movement target line 28 in the front-rear direction while continuing to move the marine vessel 1 in the lateral direction. After that, the BCU 16 generates a front-rear direction component 29 in the resultant thrust so as to eliminate a deviation in the front-rear direction from the new movement target line 28. In addition, when the BCU 16 resumes the correction control in the front-rear direction, first, the BCU 16 adjusts the output of each outboard motor 3 according to the stored forward and backward output ratio, and generates the same resultant thrust as the resultant thrust when the correction control in the front-rear direction is interrupted. It should be noted that when returning the stick 23 to the neutral position in the front-rear direction, the marine vessel user also continues to tilt the stick 23 toward the lateral direction.

Although FIG. 8 shows an example in which the marine vessel 1 deviates backward from the movement target line 26 and the new movement target line 28, when the marine vessel 1 deviates forward from the movement target line 26 and the new movement target line 28, similar correction control in the front-rear direction is executed.

Further, as described above, during movement of the marine vessel 1 in the lateral direction, since the external disturbances such as tidal currents and wind act on the hull 2, sometimes the yaw angle of the marine vessel 1 changes (the marine vessel 1 turns). In this case, sometimes the marine vessel user's line of sight deviates from the movement target line 26, and the marine vessel user may lose sight of the target position existing on the movement target line 26.

According to a preferred embodiment of the present invention, in order to compensate for this issue, a yaw angle of the marine vessel 1 when the marine vessel user tilts the stick 23 toward the lateral direction is set as a reference yaw angle, and in the lateral assist, the BCU 16 controls the acting direction and the magnitude of the thrust of each outboard motor 3 so that the marine vessel 1 does not deviate from the reference yaw angle when the marine vessel 1 moves in the lateral direction.

Figure 9:
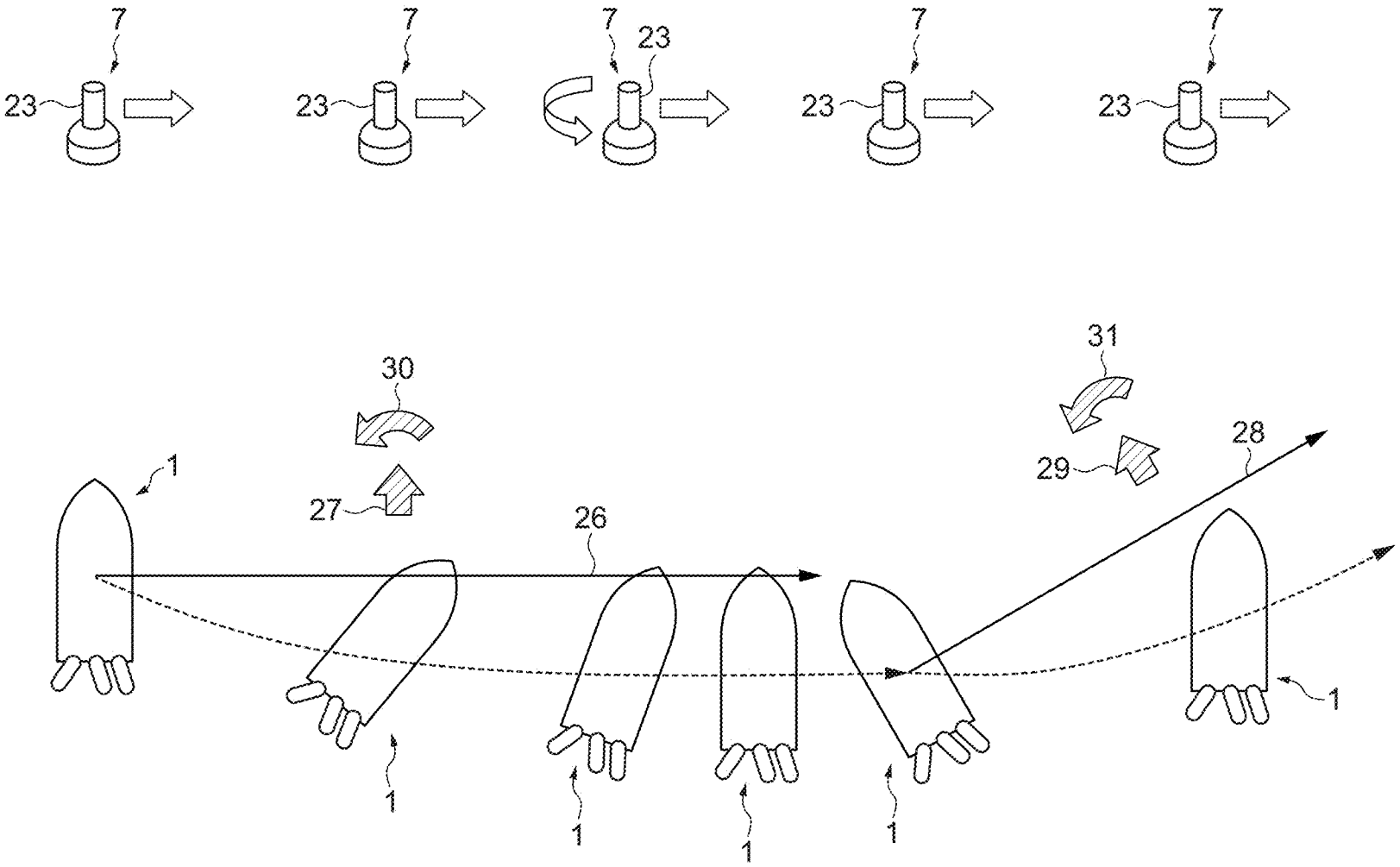
FIG. 9 is a view for explaining control of a yaw angle of the marine vessel of the lateral assist according to a preferred embodiment of the present invention.

FIG. 9 is a view for explaining control of the yaw angle of the marine vessel 1 in the lateral assist according to a preferred embodiment of the present invention.

As shown in FIG. 9, first, when the marine vessel user tilts the stick 23 of the joystick 7 toward the lateral direction, the BCU 16 sets the movement target line 26 and sets the yaw angle of the marine vessel 1 at that time as the reference yaw angle. The reference yaw angle is based on the earth coordinate system and is not affected by the turning of the marine vessel 1.

After that, when the yaw angle of the marine vessel 1 deviates from the reference yaw angle while the lateral assist is being executed and the marine vessel 1 is moving in the lateral direction, the BCU 16 performs a correction control in a yaw direction (third control) that changes the resultant thrust so as to eliminate a deviation in the yaw direction from the reference yaw angle. Specifically, by changing the forward and backward output ratio described above and the acting direction of the thrust of each outboard motor 3, generating a turning direction component 30 (a turning force) in the resultant thrust, and turning the marine vessel 1, the deviation in the yaw direction from the reference yaw angle is eliminated.

Further, while the marine vessel 1 is moving in the lateral direction, when not only the correction control in the yaw direction is executed, but also the correction control in the front-rear direction described above is executed, and the marine vessel 1 deviates from the movement target line 26 in the front-rear direction, the BCU 16 generates the front-rear direction component 27 in the resultant thrust so as to eliminate the deviation in the front-rear direction of the marine vessel 1.

According to a preferred embodiment of the present invention, the BCU 16 calculates the deviation of the marine vessel 1 from the reference yaw angle based on a comparison between the current yaw angle of the marine vessel 1 obtained by the compass 18 and the reference yaw angle.

Further, when the lateral assist of FIG. 5 is executed and the marine vessel 1 moves in the lateral direction, there are times when it is desired to actively turn the marine vessel 1. In the present preferred embodiment, in response to this, the operation of rotating the stick 23 by the marine vessel user is accepted during the execution of the lateral assist.

As shown in FIG. 9, in the case that the marine vessel 1 moves in the lateral direction in the lateral assist, when the marine vessel user twists (rotates) the stick 23 while tilting the stick 23 toward the lateral direction, for example, when the marine vessel user rotates the stick 23 clockwise (see the clockwise hollow arrow in FIG. 9), the BCU 16 temporarily interrupts the correction control in the yaw direction and the correction control in the front-rear direction, and performs a midway turning control (fourth control) that generates a turning direction component having a magnitude corresponding to an amount of rotating the stick 23 in the resultant thrust. At this time as well, movement in the lateral direction of the marine vessel 1 is continued. As a result, the marine vessel 1 turns while moving in the lateral direction.

Next, when the marine vessel user releases the rotation of the stick 23 and returns the stick 23 to the neutral position with respect to the yaw direction, the BCU 16 ends the midway turning control and terminates generating the turning direction component of the resultant thrust. Then, the BCU 16 sets a line along a lateral direction perpendicular to the front-rear direction of the hull 2 when the stick 23 is returned to the neutral position with respect to the yaw direction as a new movement target line 28, and sets the yaw angle of the marine vessel 1 at this time as a new reference yaw angle.

As shown in FIG. 9, since the new movement target line 28 is rotationally moved with respect to the movement target line 26 by the yaw angle at which the marine vessel 1 turns in the midway turning control, it is possible to easily change the direction of the movement target line by the midway turning control.

After that, the BCU 16 resumes the correction control in the yaw direction and the correction control in the front-rear direction (fifth control), generates a front-rear direction component 29 in the resultant thrust so as to eliminate a deviation in the front-rear direction from the new movement target line 28, and further generates a turning direction component 31 in the resultant thrust so as to eliminate a deviation in the yaw direction from the new reference yaw angle.

Although FIG. 9 shows an example in which the marine vessel 1 deviates clockwise from the reference yaw angle and the new reference yaw angle, when the marine vessel 1 deviates counterclockwise from the reference yaw angle and the new reference yaw angle, similar correction control in the yaw direction is executed.

Figure 10:
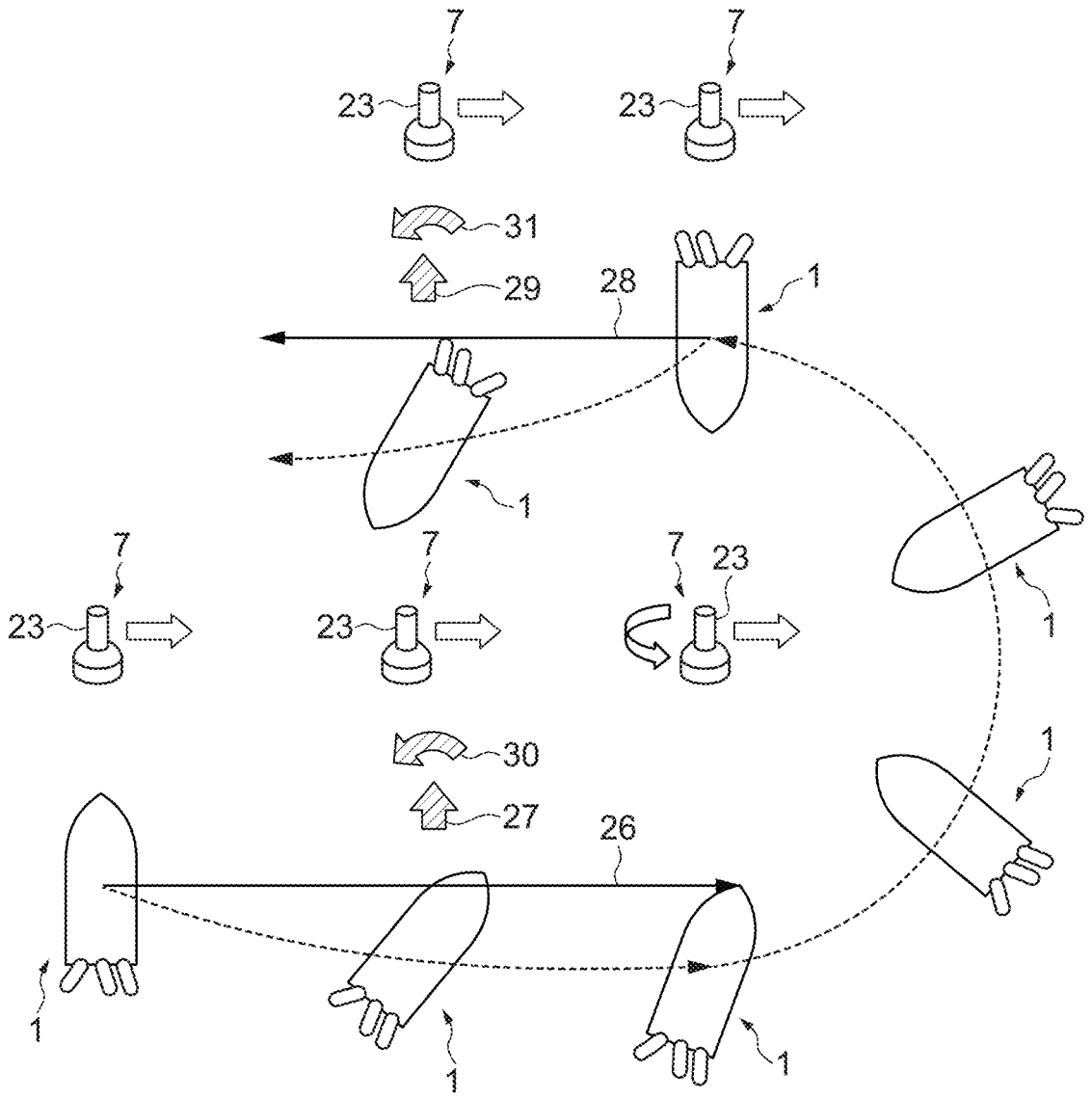
FIG. 10 is a view for explaining a case in which midway turning control is performed for a relatively long time of the lateral assist according to a preferred embodiment of the present invention.

FIG. 10 is a view for explaining a case that the midway turning control is performed for a relatively long time in the lateral assist according to a preferred embodiment of the present invention.

As described above, since moving in the lateral direction of the marine vessel 1 is continued while the midway turning control is being performed, the marine vessel 1 does not turn on the spot, but turns while moving in the lateral direction. As a result, while the marine vessel user is rotating the stick 23, the marine vessel 1 moves in a circle.

Furthermore, in the case that the tilting amount toward the lateral direction of the stick 23 is equal to or more than a tilting amount for judgment, in the lateral assist, not only the correction control in the front-rear direction is executed, but also the correction control in the yaw direction is executed. On the other hand, in the case that the tilting amount toward the lateral direction of the stick 23 is less than the tilting amount for judgment, in the lateral assist, not only the correction control in the front-rear direction is terminated, but also the correction control in the yaw direction is terminated.

The tilting amount for judgment at this time is the same as the tilting amount for judgment shown in FIG. 7. As a result, when the thrust level is low, if the stick 23 is not largely tilted, the correction control in the yaw direction will not be executed in the lateral assist. On the other hand, when the thrust level is high, the correction control in the yaw direction will be executed in the lateral assist even if the stick 23 is not largely tilted. Conversely, when the thrust level is low, the correction control in the yaw direction will be terminated in the lateral assist just by returning the stick 23 slightly from the tilted state. On the other hand, when the thrust level is high, if the stick 23 is not largely returned from the tilted state, the correction control in the yaw direction will not be terminated in the lateral assist.

Figure 11:
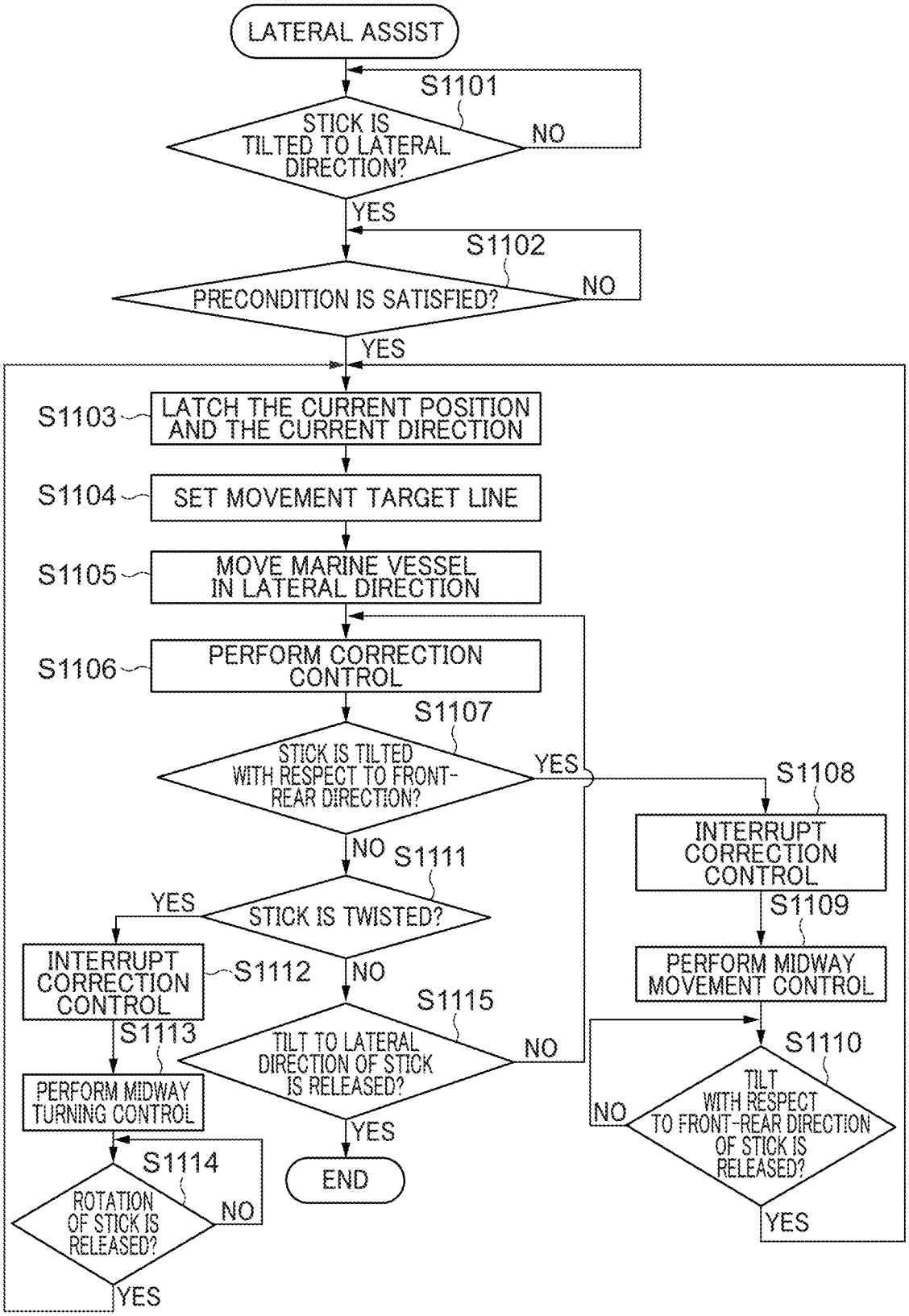
FIG. 11 is a flowchart for explaining the flow of a process of the lateral assist according to a preferred embodiment of the present invention.
Figure 12:
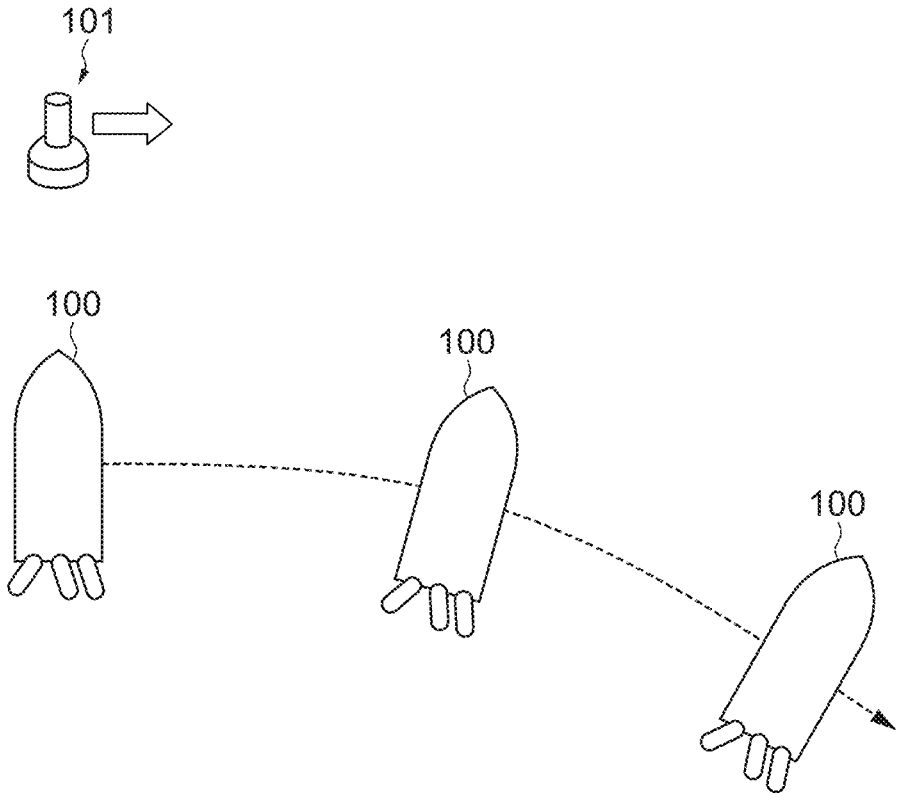
FIG. 12 Prior Art
FIG. 12 is a view for explaining movement of a conventional marine vessel in the lateral direction.

FIG. 11 is a flowchart for explaining the flow of a process in the lateral assist according to a preferred embodiment of the present invention.

As shown in FIG. 11, first, the BCU 16 judges whether or not the stick 23 is tilted toward the lateral direction, more specifically, the BCU 16 judges whether or not the tilting amount of the stick 23 exceeds the tilting amount for judgment (step S1101). In the case that the tilting amount of the stick 23 does not exceed the tilting amount for judgment, the process returns to step S1101. On the other hand, in the case that the tilting amount of the stick 23 exceeds the tilting amount for judgment, the BCU 16 judges whether or not a precondition is satisfied (step S1102).

The precondition in step S1102 includes, for example, whether or not the execution of the lateral assist is permitted by the MFD 9, whether or not the compass 18 is calibrated with respect to a traveling direction of the marine vessel 1, whether or not the marine vessel 1 includes two or more outboard motors 3, whether or not an error occurs in the GPS 17 or the compass 18, whether or not to shift to the joystick mode, and/or whether or not a forward speed component of the marine vessel 1 is lower than a predetermined speed.

In the case that the precondition is not satisfied, the process returns to step S1102. On the other hand, in the case that the precondition is satisfied (YES in step S1102), the BCU 16 stores (latches) the current position of the marine vessel 1 and the current direction (the current yaw angle) of the marine vessel 1 (step S1103), sets the current yaw angle as the reference yaw angle, and sets the movement target line 26 based on the current position and the current yaw angle (step S1104).

Next, the BCU 16 causes the respective outboard motors 3 to generate the resultant thrust and move the marine vessel 1 in the lateral direction (step S1105), and performs the correction control in the front-rear direction and the correction control in the yaw direction while the marine vessel 1 is moving in the lateral direction (step S1106).

After that, the BCU 16 judges whether or not the stick 23 is tilted in the front-rear direction (whether or not the stick 23 is tilted forward or backward) (step S1107). In the case that the stick 23 is tilted in the front-rear direction (YES in step S1107), the BCU 16 temporarily interrupts the correction control in the front-rear direction and the correction control in the yaw direction (step S1108), stores the forward and backward output ratio at this time, and then performs the midway movement control (step S1109).

Next, the BCU 16 judges whether or not tilting in the front-rear direction of the stick 23 is released (whether or not the stick 23 is returned to the neutral position in the front-rear direction) (step S1110). In the case that the tilting in the front-rear direction of the stick 23 is not released, the process returns to step S1110. On the other hand, in the case that the stick 23 is returned to the neutral position in the front-rear direction, the process proceeds to step S1103.

In step S1107, in the case that the stick 23 is not tilted in the front-rear direction, the BCU 16 judges whether or not the stick 23 is rotated (twisted) (step S1111). In the case that the stick 23 is rotated (twisted) (YES in step S1111), the BCU 16 temporarily interrupts the correction control in the front-rear direction and the correction control in the yaw direction (step S1112), and performs the midway turning control (step S1113).

Next, the BCU 16 judges whether or not rotating of the stick 23 is released (whether or not the stick 23 is returned to the neutral position with respect to the yaw direction) (step S1114). In the case that the rotating of the stick 23 is not released, the process returns to step S1114. On the other hand, in the case that the stick 23 is returned to the neutral position with respect to the yaw direction, the process proceeds to step S1103.

In step S1111, in the case that the stick 23 is not rotated, the BCU 16 judges whether or not tilting toward the lateral direction of the stick 23 is released (step S1115).

In the case that the tilting toward the lateral direction of the stick 23 is not released (NO in step S1115), more specifically, in the case that the tilting amount toward the lateral direction of the stick 23 is equal to or more than the tilting amount for judgment, the process returns to step S1106. On the other hand, in the case that the tilting toward the lateral direction of the stick 23 is released (YES in step S1115), the BCU 16 stops movement of the marine vessel 1 in the lateral direction and ends the lateral assist.

According to a preferred embodiment of the present invention, in the lateral assist, the BCU 16 sets the line along the lateral direction perpendicular to the front-rear direction of the hull 2 when the stick 23 is tilted toward the lateral direction as the movement target line 26, and when the marine vessel 1 moves in the lateral direction, the BCU 16 generates the front-rear direction component in the resultant thrust, which is the resultant force of the thrusts of the respective outboard motors 3, so as to stop the marine vessel 1 from moving away from the movement target line 26. As a result, when the marine vessel 1 moves in the lateral direction, it is possible to stop the marine vessel 1 from deviating in the front-rear direction from the position of the marine vessel 1 when the stick 23 was first tilted. Therefore, it is possible to cause the marine vessel 1 to hold the course in the lateral direction desired by the marine vessel user.

In addition, in the lateral assist, the BCU 16 sets the yaw angle of the marine vessel 1 when the stick 23 is tilted toward the lateral direction as the reference yaw angle, and when the marine vessel 1 moves in the lateral direction, the BCU 16 generates the turning direction component in the resultant thrust, which is the resultant force of the thrusts of the respective outboard motors 3, so that the marine vessel 1 does not deviate from the reference yaw angle. As a result, when the marine vessel 1 moves in the lateral direction, it is possible to stop the marine vessel user from losing sight of the target position existing on the movement target line 26.

Moreover, in a preferred embodiment of the present invention, in the case that the marine vessel 1 moves in the lateral direction in the lateral assist, when the stick 23 is tilted toward the front-rear direction (forward or backward), the BCU 16 generates a front-rear direction component (a forward component or a backward component) having a magnitude corresponding to a tilting amount toward the front-rear direction of the stick 23 (an amount of tilting forward of the stick 23 or an amount of tilting backward of the stick 23) in the resultant thrust. Further, when the stick 23 is rotated, the BCU 16 generates the turning direction component having the magnitude corresponding to the amount of rotation of the stick 23 in the resultant thrust. As a result, it is possible to correct the moving direction of the marine vessel 1 even during the execution of the lateral assist, and it is possible to minimize that the marine vessel user feels difficulty in maneuvering the marine vessel. In particular, since the marine vessel user is able to easily change the direction of the movement target line by rotating the stick 23, the marine vessel user is able to intuitively change the course of the marine vessel 1, and it is possible to reduce the burden of the course change operation on the marine vessel user.

Moreover, in a preferred embodiment of the present invention, since the allowable range is provided for tilting the stick 23 toward the lateral direction to execute the lateral assist, the marine vessel user is able to easily instruct the execution of the lateral assist with the stick 23.

Moreover, in a preferred embodiment of the present invention, in the lateral assist, when the midway movement control ends and the correction control in the front-rear direction is resumed, the BCU 16 generates the front-rear direction component 29 when the midway movement control is started in the resultant thrust. As a result, even in the case that similar external disturbances act on the marine vessel 1 before and after the midway movement control, it is possible to minimize that immediately after the correction control in the front-rear direction is resumed, the marine vessel 1 moves far away from the new movement target line 28.

Although preferred embodiments of the present invention have been described above, the present invention is not limited to the above-described preferred embodiments, and various modifications and changes can be made within the scope of the gist thereof.

For example, although the marine vessel propulsion control system 15 according to a preferred embodiment of the present invention is applied to the marine vessel 1 including the outboard motors 3, there is no limitation on the type of the marine vessel to which the marine vessel propulsion control system 15 is applied, and it may be applied to a marine vessel equipped with inboard/outboard motors or inboard motors.

Preferred embodiments of the present invention may be realized by reading out a program to perform the functions of the above-described preferred embodiments from a memory or the like included in the BCU 16 and executing the program by the BCU 16. Alternatively, preferred embodiments of the present invention may be realized by supplying the program to perform the functions of the above-described preferred embodiments to the marine vessel propulsion control system 15 via a network or a storage medium, and executing the supplied program by the BCU 16. Furthermore, preferred embodiments of the present invention may also be realized by a circuit (for example, an ASIC) that achieves one or more functions of the BCU 16.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel comprising:

a plurality of propulsion devices each able to individually control a magnitude and a direction of a thrust generated by the respective propulsion device;

an operator to move the marine vessel in a tilting direction of the operator; and a controller configured or programmed to control the magnitude and the direction of the thrust generated by each of the plurality of propulsion devices so as to move the marine vessel in the tilting direction of the operator; wherein when the operator is first tilted toward a lateral direction perpendicular to a front-rear direction of the marine vessel, the controller is configured or programmed to execute a first control to move the marine vessel in the lateral direction, and to cause each of the plurality of propulsion devices to generate a thrust to eliminate a deviation of the marine vessel in the front-rear direction from a position of the marine vessel when the operator was first tilted;

when the operator is tilted in the front-rear direction while the marine vessel moves in the lateral direction, the controller is configured or programmed to interrupt the first control and execute a second control to cause each of the plurality of propulsion devices to generate a thrust corresponding to the tilting of the operator in the front-rear direction; and when the operator is tilted within a predetermined angular range about the lateral direction, the predetermined angular range including a direction clockwise from the lateral direction and a direction counterclockwise from the lateral direction, the controller is configured or programmed to move the marine vessel in the lateral direction and execute the first control.

2. The marine vessel according to claim 1, wherein, when the operator is returned to a neutral position in the front-rear direction, the controller is configured or programmed to terminate the second control and resume the first control.

3. The marine vessel according to claim 2, wherein the thrust generated by each of the plurality of propulsion devices when the first control is resumed is the same as the thrust generated by each of the plurality of propulsion devices when the first control is interrupted.

4. The marine vessel according to claim 1, wherein the controller is configured or programmed to:

individually control the magnitudes and the directions of the thrusts generated by the plurality of propulsion devices to generate a lateral direction resultant thrust to move the marine vessel in the lateral direction; and when executing the first control, adjust a ratio of a forward moving output for forward movement generated by some propulsion devices of the plurality of propulsion devices to a backward moving output for backward movement generated by the remaining propulsion devices of the plurality of propulsion devices to adjust a front-rear direction resultant thrust to move the marine vessel in the front-rear direction.

5. The marine vessel according to claim 1, wherein, when a tilting amount toward the lateral direction of the operator is less than a predetermined tilting amount, the controller is configured or programmed to terminate the first control.

6. The marine vessel according to claim 5, wherein, the predetermined tilting amount is changed according to a level of the thrust that each of the plurality of propulsion devices is able to generate according to the tilting of the operator.

7. The marine vessel according to claim 1, wherein, while the marine vessel moves in the lateral direction, the controller is configured or programmed to execute a third control to cause each of the plurality of propulsion devices to generate a turning force to eliminate a deviation of the marine vessel in a yaw direction from a yaw angle of the marine vessel when the operator was tilted.

8. The marine vessel according to claim 7, wherein, when the operator is twisted while the marine vessel moves in the lateral direction, the controller is configured or programmed to interrupt the third control and execute a fourth control to cause each of the plurality of propulsion devices to generate a turning force corresponding to the twisting of the operator.

9. The marine vessel according to claim 8, wherein, when the operator is returned to a neutral position with respect to the twisting, the controller is configured or programmed to terminate the fourth control and resume the third control.

10. The marine vessel according to claim 9, wherein, when the operator is returned to the neutral position with respect to the twisting, the controller is configured or programmed to execute a fifth control to move the marine vessel in a new lateral direction perpendicular to the front-rear direction of the marine vessel when the operator is returned to the neutral position with respect to the twisting, and to cause each of the plurality of propulsion devices to generate a thrust to eliminate a deviation of the marine vessel in the front-rear direction from the position of the marine vessel when the operator is returned to the neutral position with respect to the twisting during movement of the marine vessel in the new lateral direction.

11. The marine vessel according to claim 7, wherein, when a tilting amount toward the lateral direction of the operator is less than a predetermined tilting amount, the controller is configured or programmed to terminate the third control.

12. The marine vessel according to claim 11, wherein the predetermined tilting amount is changed according to a level of the thrust that each of the plurality of propulsion devices is able to generate according to the tilting of the operator.

13. A marine vessel propulsion control system able to individually control magnitudes and directions of thrusts generated by a plurality of propulsion devices provided on a marine vessel, the marine vessel propulsion control system comprising:

an operator to move the marine vessel in a tilting direction of the operator; and a controller configured or programmed to control the magnitude and the direction of the thrust generated by each of the plurality of propulsion devices so as to move the marine vessel in the tilting direction of the operator; wherein when the operator is first tilted toward a lateral direction perpendicular to a front-rear direction of the marine vessel, the controller is configured or programmed to execute a first control to move the marine vessel in the lateral direction, and to cause each of the plurality of propulsion devices to generate a thrust to eliminate a deviation of the marine vessel in the front-rear direction from a position of the marine vessel when the operator was first tilted;

when the operator is tilted in the front-rear direction while the marine vessel moves in the lateral direction, the controller is configured or programmed to interrupt the first control and execute a second control to cause each of the plurality of propulsion devices to generate a thrust corresponding to the tilting of the operator in the front-rear direction; and when the operator is tilted within a predetermined angular range about the lateral direction, the predetermined angular range including a direction clockwise from the lateral direction and a direction counterclockwise from the lateral direction, the controller is configured or programmed to move the marine vessel in the lateral direction and execute the first control.

* * * * *